US008650790B2

(12) United States Patent
Dionne et al.

(10) Patent No.: US 8,650,790 B2
(45) Date of Patent: Feb. 18, 2014

(54) FIREARM SELECTOR SWITCH LOCKING APPARATUS

(71) Applicant: Megamet Solid Metals, Inc., Earth City, MO (US)

(72) Inventors: Bruce Dionne, Crestwood, MO (US); Michael Borrini, Rock Hill, MO (US)

(73) Assignee: Megamet Solid Metals, Inc., Earth City, MO (US)

( * ) Notice: Subject to any disclaimer, the term of this patent is extended or adjusted under 35 U.S.C. 154(b) by 0 days.

(21) Appl. No.: 13/671,200

(22) Filed: Nov. 7, 2012

(65) Prior Publication Data

US 2013/0111794 A1 May 9, 2013

Related U.S. Application Data

(60) Provisional application No. 61/556,524, filed on Nov. 7, 2011.

(51) Int. Cl.
*F41A 17/02* (2006.01)

(52) U.S. Cl.
USPC ..... 42/70.11; 42/70.01

(58) Field of Classification Search
USPC ..... 42/70.01, 70.11
See application file for complete search history.

(56) References Cited

U.S. PATENT DOCUMENTS

| | | | | |
|---|---|---|---|---|
| 2,342,283 | A | 2/1944 | Hyde | |
| 3,258,871 | A | 7/1966 | Green | |
| 3,882,622 | A * | 5/1975 | Perlotto | 42/70.11 |
| 3,924,512 | A | 12/1975 | Fagg | |
| 4,523,510 | A | 6/1985 | Wilhelm | |
| 5,231,236 | A | 7/1993 | Del Real et al. | |
| 5,361,525 | A | 11/1994 | Bowes | |
| 6,141,896 | A * | 11/2000 | Oberst | 42/70.06 |
| 6,173,518 | B1 * | 1/2001 | Oberst | 42/70.06 |
| 6,256,917 | B1 * | 7/2001 | Findlay | 42/70.06 |
| 6,347,538 | B1 * | 2/2002 | Doiron | 70/58 |
| 6,389,728 | B1 * | 5/2002 | Lundy | 42/70.11 |
| 6,510,641 | B1 | 1/2003 | Viani | |
| 6,550,176 | B2 | 4/2003 | Beretta | |
| 7,243,453 | B2 | 7/2007 | McGarry | |
| 7,726,059 | B2 * | 6/2010 | Pikielny | 42/70.11 |
| 2007/0180984 | A1 | 8/2007 | Huther | |
| 2008/0216376 | A1 * | 9/2008 | Pikielny | 42/70.11 |
| 2010/0132541 | A1 | 6/2010 | Hochstrate et al. | |

* cited by examiner

*Primary Examiner* — Jonathan C Weber

(74) *Attorney, Agent, or Firm* — Polster, Lieder, Woodruff & Lucchesi, L.C.

(57) ABSTRACT

A lockable safety selector switch adapted to replace a manufacturer's original safety selector switch for a firearm having a selector detent pin with a tip. The lockable safety selector switch has a body adapted to selectively orient between a SAFE position that prevents the firearm from firing and a FIRE position that allows the firearm to fire, and a locking mechanism configured to operatively associate with the firearm selector detent pin to selectively lock the body in the SAFE position. The locking mechanism has a spring-loaded cam that operatively interfaces with a key to prevent unintentional locking or unlocking of the locking mechanism. The lockable safety selector switch is configured such that the firearm requires no modification for the lockable safety selector switch to replace the original safety selector switch.

20 Claims, 8 Drawing Sheets

FIREARM SELECTOR SWITCH LOCKING APPARATUS

CROSS REFERENCE TO RELATED APPLICATIONS

This application claims the benefit of U.S. Provisional Application No. 61/556,524, entitled RIFLE RECEIVER SELECTOR SWITCH LOCKING APPARATUS AND METHOD, filed on Nov. 7, 2011. The disclosure of the above application is incorporated herein by reference.

STATEMENT REGARDING FEDERALLY SPONSORED RESEARCH OR DEVELOPMENT

Not applicable.

BACKGROUND OF THE INVENTION

This invention relates principally to a lockable firearm safety selector switch, and more particularly to a novel lockable firearm selector switch that is capable of replacing the non-lockable safety selector switch in the receiver of an AR15 rifle or other similar designs, while requiring no modifications to the firearm receiver.

It has become increasingly important for the purposes of theft prevention and public safety, to hinder the rapid use of a firearm that is otherwise in a stored condition. At least from a public perception standpoint, this has become particularly important for semiautomatic and assault weapon firearms. While no system is foolproof, a device or system that at least deters the rapid deployment and use of a firearm that would otherwise be amenable to such use is desirable.

One pervasive and very successful assault weapon widely distributed in the worldwide market is the fully automatic M16 rifle and its semiautomatic (civilian or sport) version, the AR15. Millions of these rifles and their variants have been produced and continue to be produced and utilized throughout the world. One significant aspect of these rifles is the designed and specified interchangeability of the rifle's individual components, and each manufacturer of the AR15 must produce its rifles to meet these interchangeability specifications. That is, the rifle has been designed for maximum interchangeability of the vast majority of the rifle components such that, for example, a trigger assembly from one AR15 can be utilized in a different AR15 simply by swapping the components between the two firearms. With particular regard to the present invention, the AR15 share a common and interchangeable set of safety selector switches. Each AR15 has a safety selector switch. Unfortunately, none of the original equipment manufacturer ("OEM") safety selector switches are lockable.

It is desirable, therefore, to devise a safety selector switch for a firearm, and in particular for an AR15 rifle, that is interchangeable with the OEM safety selector switch. In addition, it is further desirable to devise such a lockable safety selector switch that requires no modification to the firearm's receiver to either install or operate.

While the preferred embodiment of the present invention is directed to a lockable safety selector switch for an AR15 rifle, the invention is equally applicable to other models firearms, both rifles and hand guns.

As will become evident in this disclosure, the present invention provides benefits over the existing art.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

Figure 1:
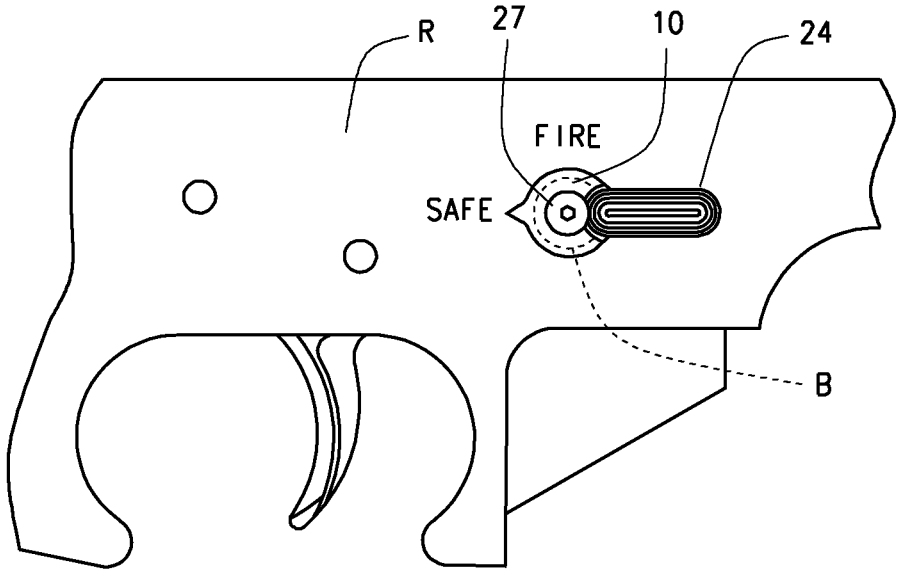
FIG. 1 is a side view of a portion of a receiver of a firearm having a lockable safety selector switch of one embodiment of the present invention.
Figure 2:
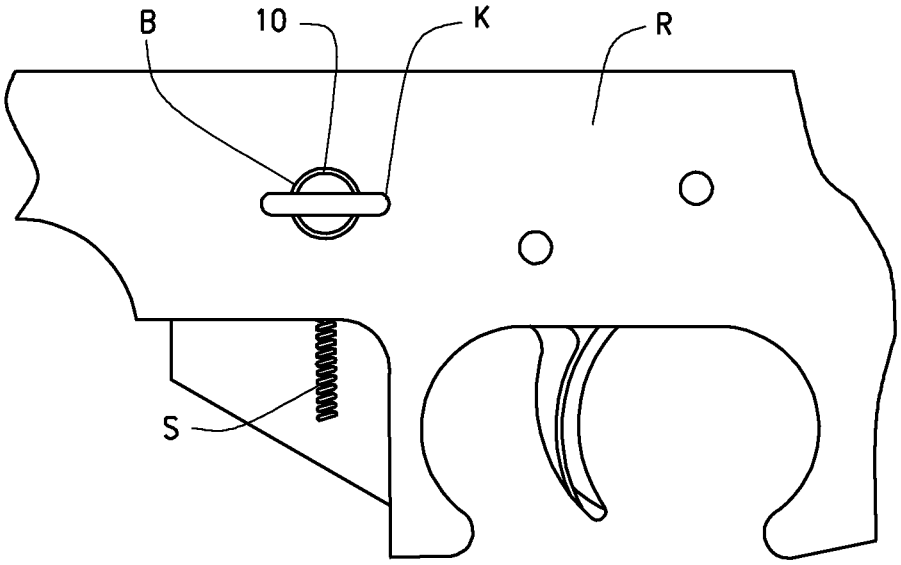
FIG. 2 is a side view opposite of FIG. 1 of a portion of a receiver of a firearm having a lockable safety selector switch of one embodiment of the present invention, and having a key engaged with the switch.

In referring to the drawings, an embodiment of a lockable safety selector switch 10 for a receiver R (FIGS. 1, 2) of a firearm, such as for example an AR15, of the present invention is shown generally in FIGS. 3-18, where the present invention is depicted by way of example, and is shown in FIGS. 3, 5 and 14-15 to interact with a firearm selector detent pin P having a tip T associated with a compression spring S, and with a trigger arm A (FIGS. 5, 17-18), which are all located within the receiver R. As can be seen, the switch 10 comprises a switch body 12, a movable detent 14, a floating cam 16, a compression cam spring 17 and an assembly cap 18, the components inside the body 12 comprising a locking mechanism. The switch body 12 is configured to match where necessary the outer surface configuration of the manufacturer's original, or "spec", selector switch for a desired firearm; here, an AR15. This facilitates the replacement of an OEM selector switch with a novel lockable safety selector switch 10 of the present invention without any modification to the firearm or the switch 10. However, while an OEM selector switch is typically solid metal, the selector switch 10 of the present invention is hollow and comprises locking components contained within the switch body 12 to facilitate its locking function.

Referring to FIGS. 3-5 and 14-15, the switch 10 comprises a generally cylindrical shaft 20 having a central axis X, a proximal end 21 and a distal end 25. A generally cylindrical central portion 22 that is coaxial with but has a diameter slightly less than the shaft 20 extends approximately along the central third of the shaft 20. The central portion 22 has a flat surface 23 along one side. The proximal end 21 of the shaft 20 has a central threaded bore 21*a* that is coaxial with the axis X, and a shallow slot 21*b*, having a generally rectangular cross-section, is formed across the full width of, and bisects, the proximal end 21.

A detachable lever 24 (FIG. 16) is configured for attachment to the proximal end 21 of the shaft 20 (FIGS. 3-5), the lever 24 having a top 24*a* and a base 24*b*. The detachable lever 24 has at one end an attenuated rounded top lever arm 24*c* and an arrowhead 24*d* formed opposite the lever arm 24*c*. A throughbore 24*e* is formed in the detachable lever 24 in proximity to the point 24*d*, the bore 24*e* being configured to allow a screw 27 to snugly yet freely pass therethrough. A protrusion 24*f* is formed on the base 24*b* of the detachable lever 24, the protrusion 24*f* configured to snugly yet removably mate with the slot 21*b* in the proximal end 21 of the shaft 20. As can be appreciated, when the detachable lever 24 is positioned against the proximal end 21 of the shaft 20, with the protrusion 24*f* mated within the slot 21*b* and with the throughbore 24*e* aligned with the threaded bore 21*a*, the detachable lever 24 can be securely, yet removably, attached to the shaft 20 by screwing the screw 27 into the threaded bore 21*a*. The detachable lever 24 then extends laterally from one end of the shaft 20, and is configured to allow the firearm operator to rotate the switch 10 about the axis X when the switch 10 is properly positioned within the receiver R of a firearm.

At the distal end 25 of the shaft 20, a cylindrical bore 26, also having its central axis at X, extends approximately one third of the way into the shaft 20. The bore 26 has an open distal end 28 and a closed proximal end 30 and is configured to house the floating cam 16 freely rotatable there within. The bore 26 does not extend into the central portion 22. Further, a small cylindrical bore 34 (FIGS. 4, 14, 15), centered upon and coaxial with the axis X, extends from the proximal end 30 of the bore 26 further into the shaft 20 in the direction of the proximal end 21. In addition, a plug or other cover (not shown) can be fashioned of rubber or some other suitable material such that the plug or cover can be removably secured in the cap 18 to seal the interior of the switch body 12 from the elements, including dust, grime and moisture.

A arcuate slot 50 (FIGS. 3-5, 17-18) is formed radially about the axis X in a portion of the shaft 20 near the distal end 28 of the bore 26. The slot 50 has a generally concave profile that extends for a distance of approximately one fourth the circumference of the shaft 20. The slot 50 terminates at one end at a generally cylindrical throughbore 52 and at the other end at a concave depression 54, where the outer diameters of the bore 52 and the upper edge of the depression 54 are both equal to the width of the slot 50, and there between form an arcuate groove 56 along the bottom of the slot 50. Further, the bore 52 and depression 54 align with the slot 50 such that the upper edge of the slot 50 smoothly integrates into the upper edges of the bore 52 and the depression 54. The bore 52 penetrates from the outer surface of the shaft 20 through to the bore 26 and has parallel ledges 53 formed on opposing sidewalls below the level of the slot 50. The depression 54, though not a throughbore, extends further into the shaft 20 than the groove 56. The width of the slot 50 is such that the slot 50 can closely yet freely receive the tip T of the selector detent pin P at any position along the full length of the slot 50 when the switch 10 is properly installed in the receiver R (see FIGS. 2, 14-15), and the selector detent pin P can closely yet freely extend into either of the throughbore 52 or the depression 54.

Figure 5:
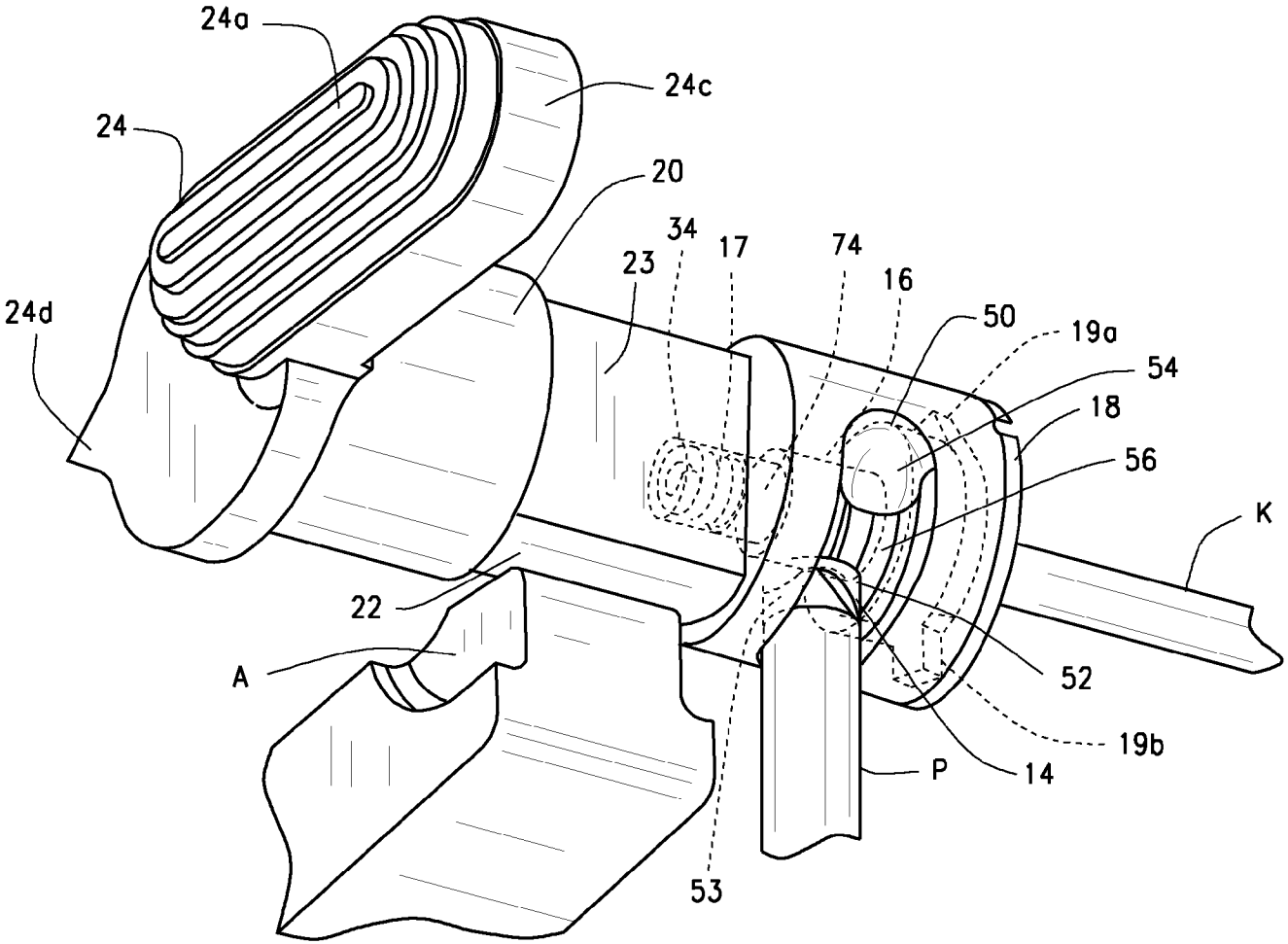
FIG. 5 is a partially transparent perspective view of the lockable safety selector switch of FIG. 3 in a fully assembled condition, showing the selector switch engaged with a key, a firearm selector detent pin and a firearm trigger arm.
Figure 6:
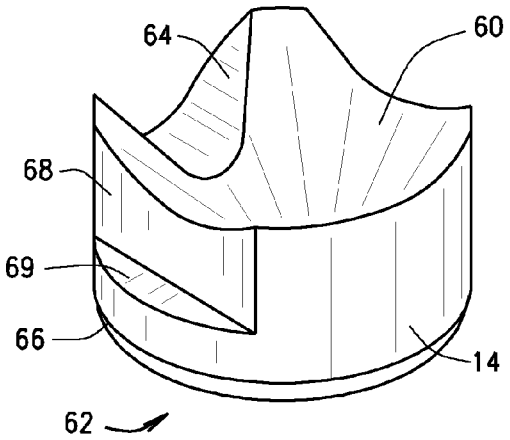
FIG. 6 is a perspective view of the movable detent of the lockable safety selector switch of FIG. 3.
Figure 7:
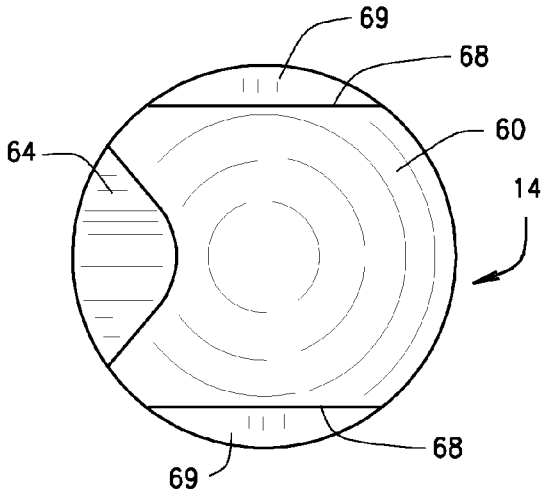
FIG. 7 is a plan view of the movable detent of the lockable safety selector switch of FIG. 3.

Referring now to FIGS. 6 and 7, it can be seen that the movable detent 14 is generally cylindrical, with a generally concave lower end 60 and an opposing generally flat upper end 62. A sinusoidal groove 64 along the outer edge of the lower end 60 extends from the outer surface of the movable detent 14 to the inner concave surface of the lower end 60. The groove 64 is shaped to conform to shape of the tip T of the selector detent pin P. The upper end 62 of the movable detent 14 is raidused to form a curved rim 66 along the outer edge of the upper end 62. Two matching parallel peripheral flats 68 are formed along opposing sides of the movable detent 14, and extend from the lower end 60 to two matching and opposing and coplanar ledges 69 formed near the upper end 62. The ledges 69 are configured to mate with the ledges 53 in the bore 52 at one end of the slot 50 in the shaft 20. The flats 68 are configured to enable the movable detent 14 to fit within and slide along the curved surface of the slot 50 while the ledges 69 prevent the movable detent 14 from passing entirely through the slot 50 (see FIGS. 4-5, 14-15).

Figure 8:
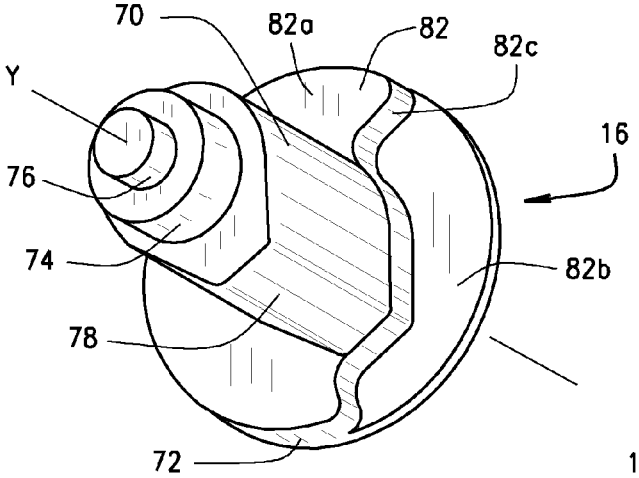
FIG. 8 is a bottom perspective view of the floating cam of the lockable safety selector switch of FIG. 3.
Figure 9:
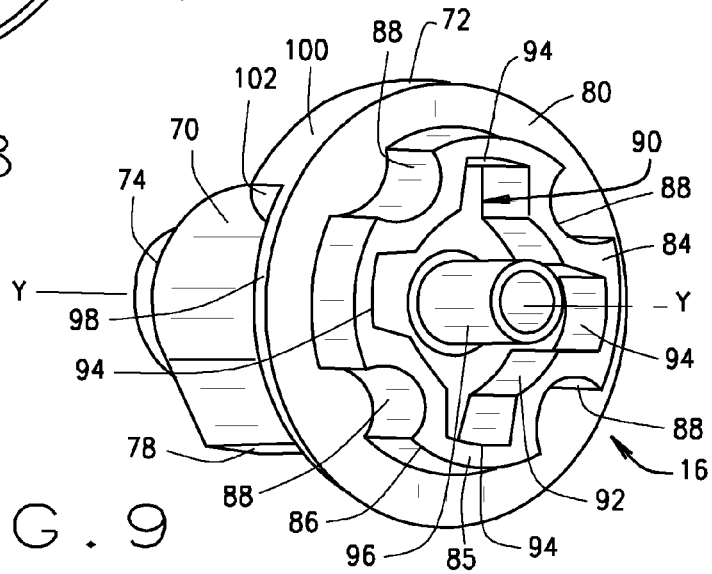
FIG. 9 is a top perspective view of the floating cam of the lockable safety selector switch of FIG. 3.
Figure 10:
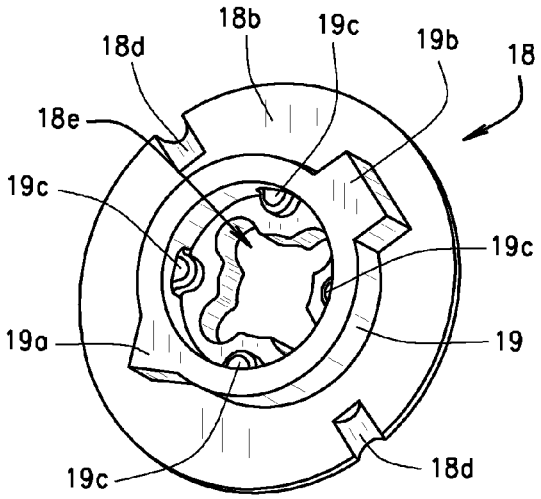
FIG. 10 is a bottom perspective view of the underside of the assembly cap of the lockable safety selector switch of FIG. 3.
Figure 11:
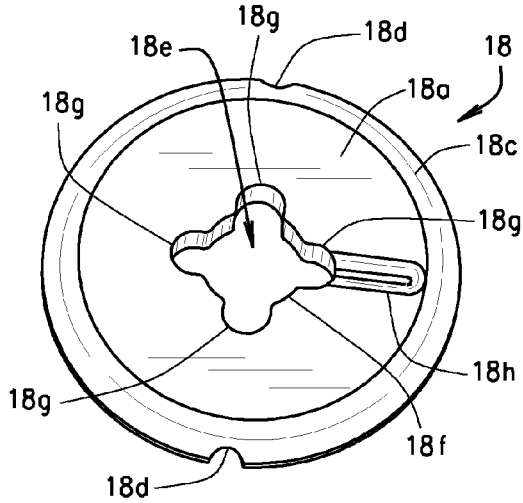
FIG. 11 is a top perspective view of the top of the assembly cap of the lockable safety selector switch of FIG. 3.

Referring to FIGS. 8 and 9, it can be seen that the floating cam 16 has the general shape of a nail or brad with a disc 72 formed at one end and a generally cylindrical shaft 70 protruding from the disc 72, with both the disc 72 and shaft 70 formed about a common central axis Y. A first cylindrical protrusion 74, having a diameter smaller than that of the shaft 70 protrudes from the end of the shaft 70 opposite the disc 72. A second cylindrical protrusion 76, having a diameter smaller than that of the first cylindrical protrusion 74 protrudes from the end of the first cylindrical protrusion 74 opposite the shaft 70. The shaft 70, the disc 72 and the first and second cylindrical protrusions 74 and 76 are all coaxial. Although generally cylindrical, the surface of the shaft 70 is defined by a cross-sectional truncated teardrop shape along its full length such with a flattened ridge 78 formed along the length of the shaft 70, the ridge 78 being parallel to the central axis Y of the shaft 70.

The disc 72 has a generally flat upper surface 80 and a generally flat lower surface 82 opposite the upper surface 80, with a protrusion 84 projecting from the upper surface 80. The protrusion 84 has a flat top 85 and a generally circular perimeter 86 with four generally semicircular indentations 88 spaced equidistant apart such that the protrusion has the general shape of a cross. A central recess 90 is formed within the perimeter 86, the recess 90 having a depth within the protrusion 84 that exposes the upper surface 80 of the disc 72 at the bottom of the recess 90. The recess 90 has a central region 92 that is circular but has four equally spaced matching fingers 94 that project radially from the central region 92, each positioned between two of the indentations 88 in the perimeter 86 of the protrusion 84. Consequently, the recess 90 is also generally cross-shaped and configured and oriented to substantially match the general shape of, and fit within, the perimeter 86. In the center of the recess 90, a cylindrical protrusion 96 projects upward from the surface 80 of the disc 72 approximately twice the height of the protrusion 84. The protrusion 96 is coaxial with the axis Y of the floating cam 16.

Figure 12:
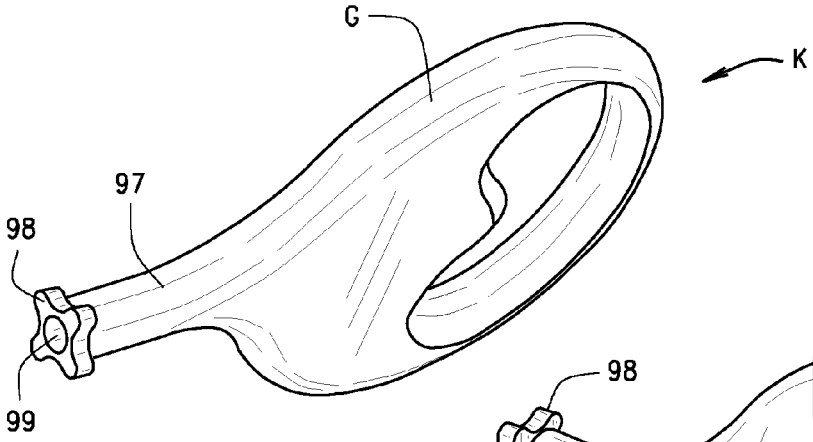
FIG. 12 is a perspective view of the key of the lockable safety selector switch of FIG. 3.
Figure 13:
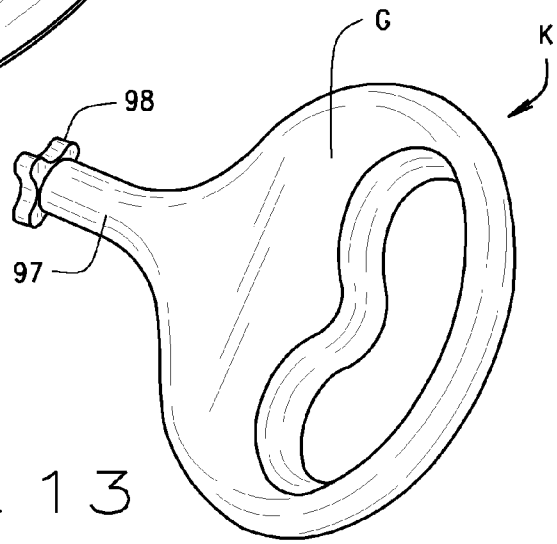
FIG. 13 is a another perspective view of the key of the lockable safety selector switch of FIG. 3.

The configuration of the protrusion 84 and the protrusion 96 are such as to operatively mate with a key K (FIGS. 12, 13). The key K has a generally cylindrical central shaft 97 with a cloverleaf-shaped tip 98 flaring out radially from one end of the shaft 97, and a widened flat grip G opposite the tip 98. A central bore 99 is formed in the center of the tip 98, the bore 99 being generally coaxial with the shaft 97. As can be appreciated, the tip 98 is configured to mate with and fit snugly into the protrusion 84 formed in the cam 16, while the bore 99 is configured to simultaneously receive the protrusion 96.

Returning to FIGS. 8 and 9, the lower surface 82 of the disc 72 is bi-level with a first segment 82*a* and a second segment 82*b*. The segments 82*a* and 82*b* are parallel to one another and to the upper surface 80, and are joined by a ridge 82*c* such that the disc 72 is thicker in the area of the segment 82*a* than in the area of the segment 82*b*. As can be seen in FIG. 8, the segment 82*a* forms a generally crescent-like shape that arcs approximately 210 degrees about the outer contours of the shaft 70, and the segment 82*b* forms a complimentary generally crescent-like shape that arcs approximately 150 degrees about the outer contours of the shaft 70.

As can be seen in FIGS. 3, 5 and 14-15, the floating cam 16 is configured to fit within the cylindrical bore 26 of the shaft 20. The first cylindrical protrusion 74 is configured to fit at least partly within and rotate freely within the bore 34. Further, the spring 17 is configured to fit about the second cylindrical protrusion 76 and then fit within the bore 34 in the shaft 20 along the axis X such that the first and second cylindrical protrusions 74 and 76 and the spring 17 can rotate therein. Hence, when the spring 17 is positioned about the protrusion 76 within the bore 34, and the floating cam 16 is thereby positioned within the bore 26, the axis Y and the axis X are coaxial and there is little non-axial free play (see FIGS. 5, 14-15). Further, the protrusions 74 and 76 are collectively shorter than the depth of the bore 34, and the spring 17 is sized such that when placed about the protrusion 76 within the bore 34 the spring 17 provides a constant bias against the first protrusion 74 to push the cam 16 away from the proximal end 30 of the bore 26. As such, the cam 16 is thereby "floating" or "spring-loaded" within the bore 26. Of course, the bore 34 and corresponding cylindrical detent 76 may be configured in other shapes, such as for example, a conical bore and a matching conical detent, so long as their shapes provide for placement of a biasing device between the shaft 20 and the bore 34, and provide for axial alignment of and rotation of the floating cam 16 within the cylindrical bore 26. Alternately, the spring 17, or some other biasing device, may be placed outside of the bore 34, so long as the spring 17 or other biasing device applies a biasing force against the shaft 20 directed away from the proximal end 30 of the bore 26.

The assembly cap 18 (FIGS. 3, 5, 10-11) is essentially a cover that is utilized to close off and seal the bore 26 of the body 12. However, the cap 18 also functions as a restraint to hold the cam 16 within the bore 26 against the "spring-loaded" bias from the spring 17 directing the cam 16 away from the proximal end 30 of the bore 26 and toward the cap 18. The cap 18 has a lower surface 18*b* (FIG. 10) and an upper surface 18*a* (FIG. 11), the upper surface 18*a* having a perimeter edge 18*c* that is chamfered. A somewhat clover-leaf shaped keyhole aperture 18*e* is formed in the center of the cap 18. The keyhole aperture 18*e* has a generally circular central portion 18*f* with four matching radially expanded semicircular alcoves 18*g* spaced equidistant from one another about the central circular portion 18*f*. A linear channel 18*h* having a semicircular cross-section extends from one of the alcoves 18*g* to the chamfered perimeter edge 18*c* of the upper surface 18*a*, where the channel 18*h* terminates in a rounded nub.

The keyhole aperture 18*e* in the cap 18 is configured to allow the tip of the key K to freely pass through the keyhole aperture 18*e* to facilitate operative engagement of the key K with the protrusion 84 and the protrusion 96 on the cam 16.

A generally ring-shaped protrusion 19 projects from the lower surface 18*a*, with an arrowhead 19*a* that extends outwardly from one end and a rectangular lug 19*b* that extends outwardly generally opposite the lug 19*a*. A set of four matching semicircular protrusions 19*c* are formed within the protrusion 19. All of the protrusions 19*c* are spaced equidistant from one another about the inner perimeter of the protrusion 19. The protrusions 19*c* are approximately half the height of the protrusion 19, with flat tops having chamfered edges.

Figure 3:
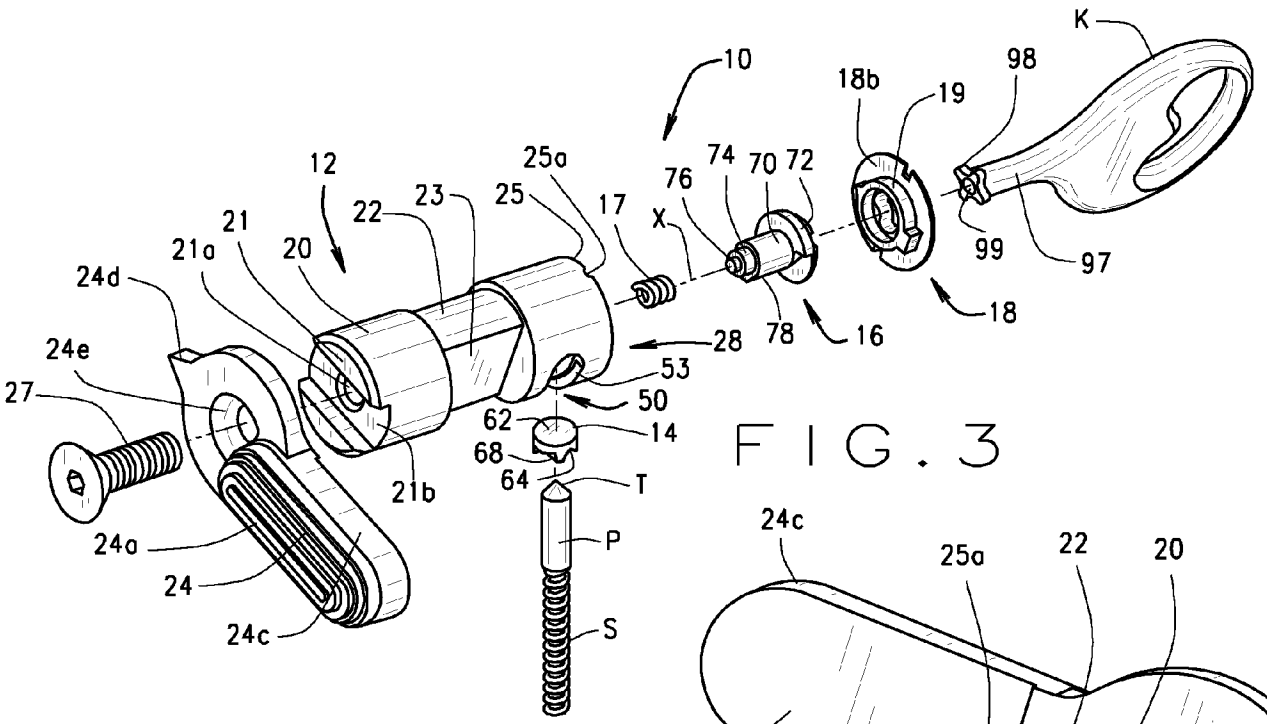
FIG. 3 is an exploded perspective view of first embodiment of a lockable safety selector switch of the present invention, showing the interaction of a key and a firearm selector detent pin with the selector switch.
Figure 4:
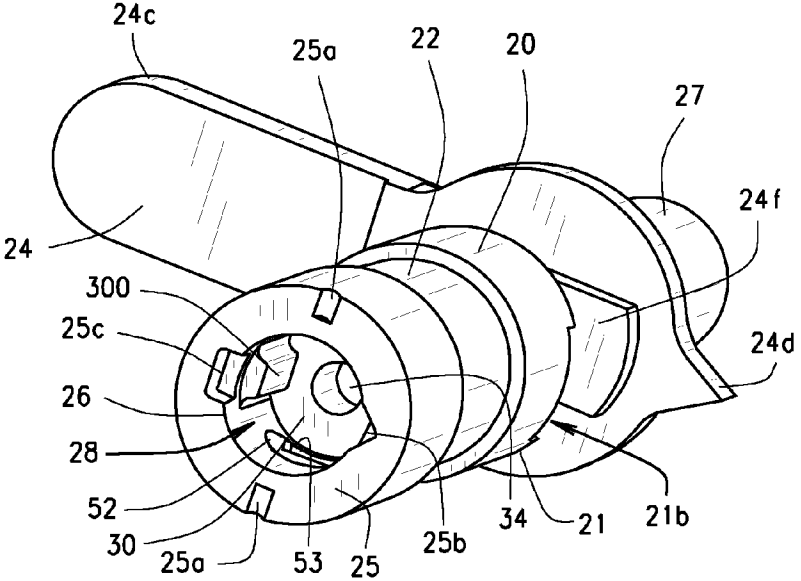
FIG. 4 is an exploded perspective view of the shaft, lever and screw of the lockable safety selector switch of FIG. 3.

As can be seen in FIG. 4, the distal end 25 of the shaft 20 is configured with an arrowhead-shaped recess 25*b* that extends radially outward from one side of the distal end 28 of the bore 26 and a rectangular recess 25*c* that extends radially outward from the opposite side of the distal end 28. The shape of the distal end 28 can thereby matingly receive the protrusion 19 in a single orientation so as to close and seal the bore 26. (FIGS. 3-5). Two weld notches 18*d* are formed in the perimeter 18*c* of the cap 18, and corresponding weld notches 25*a* are likewise formed in the distal end 25 of the shaft 20. In order to secure the cap 18 in place when mated to the distal end 28 of the bore 26, the cap 18 is welded at the weld notches 18*d* and 25*a* (not shown).

Referring to FIGS. 3-5, the switch 10 is assembled by placing the movable detent 14 through the bore 26 and into the bore 52 with the lower end 60 facing away from the axis X in the bore 26 and with upper end 62 facing toward the axis X and partially protruding into the bore 26. The dimensions of the movable detent 14 and the peripheral flats 68 are such that detent 14 cannot pass entirely through the bore 52, but that the peripheral flats 68 will align with and fit slidingly against the sidewalls of the bore 52 and that the orientation of the sinusoidal groove 64 is such that the groove 64 will align with the slot 50. In this way, the tip T of the selector detent pin P can slide along the slot 50 and into the concave lower end 60 of the movable detent 14 through the sinusoidal groove 64. The ledges 69 prevent the movable detent 14 from passing out of the bore 26 entirely through the bore 52, and thereby hold the movable detent 14 nested in the bore 52.

Next, the spring 17 is positioned about the cylindrical protrusion 76 of the cam 16 and the cam 16 is then placed in the bore 26 such that the spring 17 and the cylindrical protrusions 74 and 76 nest within the bore 34 at the proximal end 30 of the bore 26 in the shaft 20. In this orientation, the upper surface 80 of the cam 16 is directed away from the proximal end 30 of the bore 26 and the axis Y of the cam 16 aligns with and becomes substantially collinear with the axis X of the shaft 20. When placing the cam 16 in the bore 26, the cam 16 is axially oriented such that first segment 82*a* of the disc 72 is directed generally perpendicular to the slot 50 and operatively engages a small limiting detent 300 (FIG. 4) protruding from the side of and into the bore 26. The engagement between the ledge 82*c* and the limiting detent 300 restricts the rotation of the cam 16 within the bore 26 such that the cam 16 can only rotate along the arc defined by the second segment 82*b* of the disc 72.

The cap 18 is then placed over the cam 16 with the lower surface 18*b* of the cap 18 directed toward and operatively engaging the upper surface 80 and the protrusion 84 of the cam 16. The cap 18 is oriented such that the arrowhead 19*a* and rectangular lug 19*b* of the protrusion 19 mate with the arrowhead-shaped and rectangular recesses 25*b* and 25*c*, respectively, formed in the distal end 25 of the body 12. In this orientation, the weld notches 18*d* on the lower surface 18*b* align with the weld notches 25*a* formed in the distal end 25 of the body 12. Because the cam 16 is biased (i.e. "spring-loaded") by the spring 17, the cam 16 presses against the cap 18 and the cap 18 must therefore be pressed and held by force against the cam 16 to allow the cap to be attached to the body 12. The cap 18 is then secured to the distal end 25 by welding at the weld notches 18*d* and 25*a*, injecting adhesive into the notches, or implementation of some other similar attachment method.

When the cap 18 is secured in proper orientation to the distal end 25 of the body 12, the keyhole aperture 18*e* in the cap 18 aligns with and exposes the protrusion 84 and the protrusion 96 on the cam 16, allowing a user to access the cam 16 and use the key K to lock or unlock the switch 10 through the cap 18. Further, each of the components of the switch 10 is configured such that when the switch 10 is properly assembled, the spring 17 biases the cam 16 away from the proximal end 30 of the bore 26, creating a slight gap there between, and simultaneously pushes the cam 16 into biased (i.e. "spring-loaded") contact with the cap 18 such that the protrusion 84 projecting from the upper surface 80 of the cam 16 operatively interfaces and selectively interlocks with the protrusion 19 and associated lugs 19*c* formed on the lower surface 18*a* of the cap 18.

As a consequence, when the cam 16 is rotationally oriented within the bore 26 such that the top 85 of the protrusion 84 is pressed by the spring 17 against the tops of the semicircular protrusions 19*c* formed within the protrusion 19, the cam 16 can be slightly rotated in either direction about the conjoined axes X and Y, limited by the arc of rotation defined by the interface between the engagement between the first segment 82*a* and the limiting detent 300.

However, when the axial orientation of the cam 16 within the bore 26 is such that the semicircular indentations 88 formed in the protrusion 84 orient with their respective semicircular protrusions 19*c*, the cam 16 is pushed by the spring 17 toward the cap 18 and the indentations 88 thereby surround and fully engage the protrusions 19*c*, thereby interlocking the cam 16 against the cap 18 and preventing the cam 16 from rotating.

In order to thereafter rotate the cam 16, it is necessary to disengage the indentations 88 and the protrusions 19*c* from one another. This is accomplished by placing the key K through the aperture 18*e* in the cap 18, engaging the key K with the protrusion 84 formed on the cam 16 such that the tube 90 fits within the bore 99 of the key K, pushing the key K toward the proximal end 30 of the bore 26 sufficiently to disengage the indentations 88 and the protrusions 19*c*, and then rotate the cam 16 as desired. When the cam 16 reaches a point in its rotation when the indentations 88 and the protrusions 19*c* are again aligned, the pressure on the key K can be released to allow the indentations 88 and the protrusions 19*c* to reengage and thereby releasably interlock the cam 16 with the cap 18 at the new rotational orientation. Because the cam 16 requires positive, pressured engagement to rotate the cam 16 once the indentations 88 and the protrusions 19*c* are interlocked, this "spring-loaded" feature of the switch 10 acts to prevent the unintentional rotation of the cam 16 within the bore 26, and consequently prevents the unintentional locking or unlocking, of the switch 10.

Figure 17:
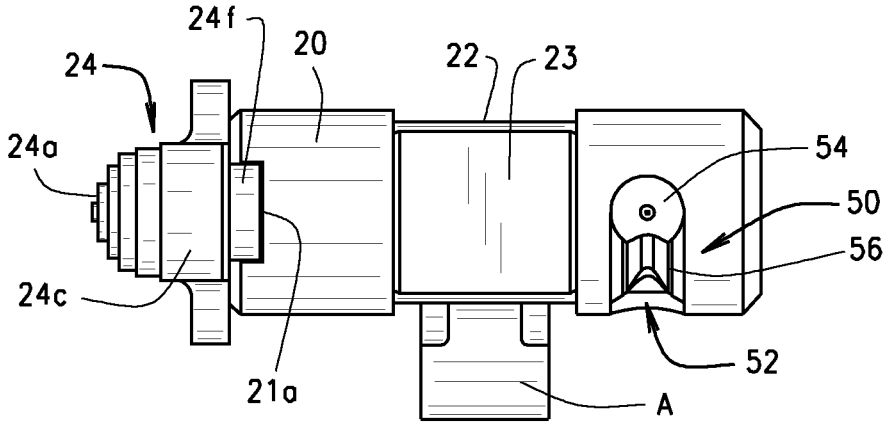
FIG. 17 is a side view of the lockable safety selector switch of FIG. 3 in a fully assembled condition engaging the firearm's trigger arm in the SAFE position.
Figure 18:
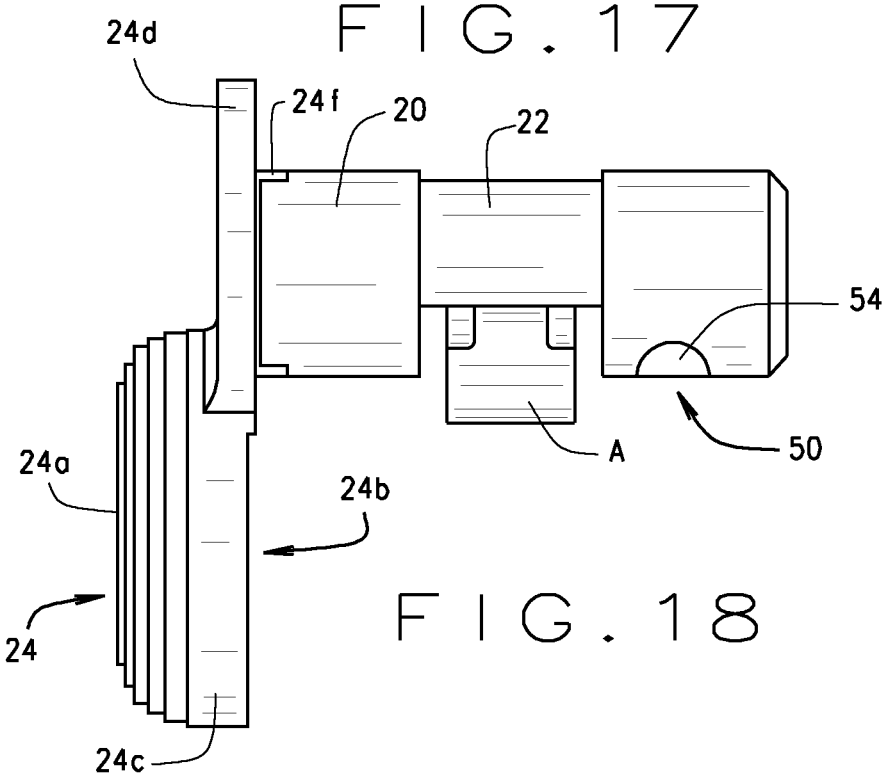
FIG. 18 is a side view of the lockable safety selector switch of FIG. 3 in a fully assembled condition interfacing with the firearm's trigger arm in the FIRE position.

After assembly, the switch 10 is ready to be installed in the receiver R. To do so, the selector detent pin P and its associated spring S must first be removed from the receiver R. The switch 10 is then positioned in the receiver R in place of the original OEM selector switch. (See FIGS. 1-2, 14-15). The selector detent pin P and spring S are then reinstalled in the receiver R such that the tip T of the selector detent pin P engages the slot 50 or the lower end 62 of the movable detent 14, depending on the rotational orientation of the switch 10 in the receiver R. The spring S thereby provides a bias that holds the selector detent pin P in engagement with the switch 10, and holds the switch 10 properly in position in the receiver R. (FIGS. 3-5, 14-15). In addition, when properly installed, the trigger arm A of the receiver R, which is capable of movement in an arc from a first lower position to a second upper position within the receiver R, positively and with a bias engages the shaft 20 at either the central portion 22 or alternatively the flat surface 23, depending on the rotational orientation of the shaft 20 within the receiver R. (FIGS. 5, 17-18). Importantly, when the trigger arm A engages the cylindrical central portion 22, the trigger arm is not able to reach its second upper position and the firearm is consequently unable to fire and is therefore in a "SAFE" mode. In contrast, when the trigger arm A engages the flat surface 23, the trigger arm is able to reach its second upper position and the firearm is consequently able to fire and is therefore in a "FIRE" mode.

Hence, as can be appreciated, once the switch 10 is properly installed in the receiver R, the key K can be inserted through the keyhole aperture 18*e* and into engagement with the protrusion 84 and protrusion 96 formed on the cam 16 to selectively lock or unlock the switch 10. By pressing the key K against the cam 16 sufficient to disengage the indentations 88 and the protrusions 19*c*, the key K can rotate the cam 16 about the collinear axes X and Y.

Figure 15:
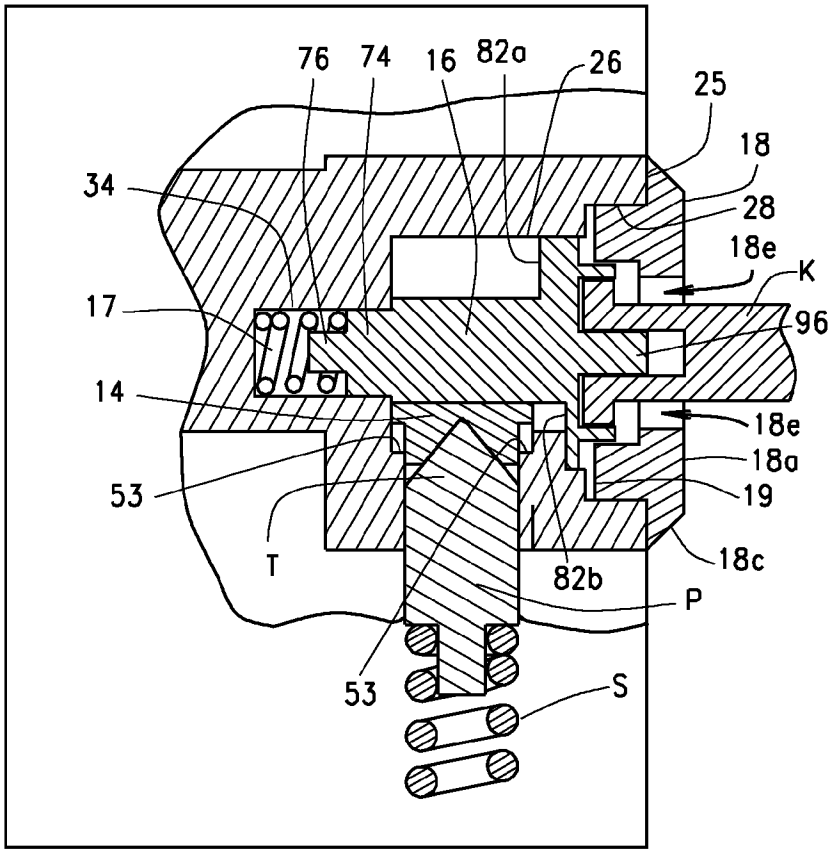
FIG. 15 is a partially cut away front sectional view of the lockable safety selector switch of FIG. 3 positioned within a firearm receiver and interacting with the firearm's selector detent pin, with the key engaging the switch, and the switch in a locked condition.
Figure 14:
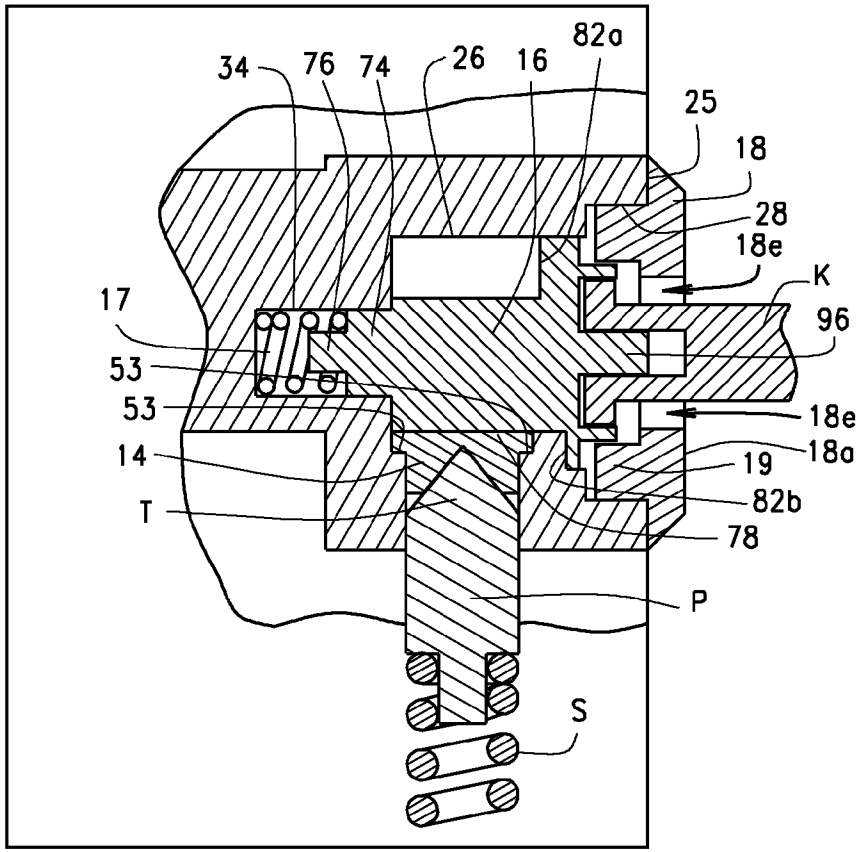
FIG. 14 is a partially cut away front sectional view of the lockable safety selector switch of FIG. 3 positioned within a firearm receiver and interacting with the firearm's selector detent pin, with the key engaging the switch, and the switch in an unlocked condition.
Figure 16:
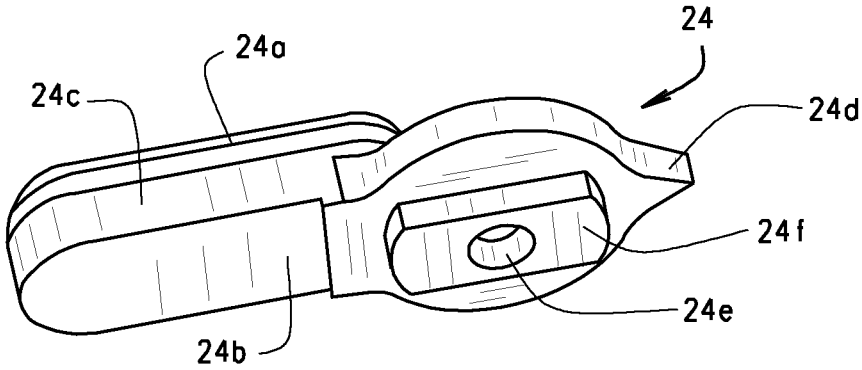
FIG. 16 is a perspective view of the detachable lever of the lockable safety selector switch of FIG. 3.

When the switch 10 is axially oriented within the receiver R such that the tip T of the selector detent pin P engages the movable detent 14, the spring S biases the movable detent 14 upward and against the shaft 70 of the cam 16 in a movable engagement. Because the shaft 70 is teardrop-shaped, rotation of the cam 16 about the axis Y causes the movable detent 14 to track the positional orientation of the interface between the shaft 70 and the movable detent 14, such that the rotation of the cam 16 in one direction forces the movable detent 14 downward away from the axis Y to a first downward position at one end of the limited rotation of the cam 16 (FIG. 14), where the movable detent 14 engages the ridge 78 of the cam 16, and rotation of the cam 16 in the opposite direction allows the movable detent 14 to extend upward toward the axis Y to a second upward position at the other end of the limited rotation of the cam 16 (FIG. 15). The cam 16 thereby acts as a tumbler within the locking mechanism of the switch 10. The displacement of the movable detent 14 between the downward position and the upward position is very slight, and in one embodiment is equal to 0.025 inches.

Referring to FIGS. 3-5, 14, as the cam 16 is rotated clockwise about its axis Y within the bore 26 by the key K, the teardrop shape of the shaft 70 results in the diameter of the shaft 70 expanding away from the axis Y and forces the movable detent 14 to its downward position (see FIG. 14), where the sinusoidal groove 64 aligns with the groove 56 in the slot 50. In this way, the selector detent pin P is free to move out of the throughbore 52 and out of the concave lower end 60 of the movable detent 14, through the groove 64, and along the groove 56 in the slot 50 to engage the depression 54 under bias from the spring S when the shaft 20 is rotated about the axis X by turning the lever arm 24. The depression 54 is deep enough to allow the spring S to bias the tip T of the selector detent pin P to snap into the depression 54 and releasably hold the selector detent pin P thereat, but not so deep as to prevent the lever arm from rotating back about the axis X to move the selector detent pin P out of the depression 54. The ability of the selector detent pin P to move along the groove 56 in the slot 50 in turn allows the flat 23 of the shaft 20 to be rotated into alignment with the trigger arm A such that the trigger arm A can rotate upward in contact with the flat 23 and thereby place the firearm in its "FIRE" mode to allow the firearm to be fired (see FIG. 18). Hence, when the key K is rotated clockwise to move the movable detent 14 to its downward position, the selector switch 10 is in an unlocked condition, and allows the user to freely select between the firearm's "SAFE" and "FIRE" modes.

Conversely, when the cam 16 is rotated counterclockwise about its axis Y within the bore 26 by the key K, the teardrop shape of the shaft 70 results in the reduction in the size the diameter of the shaft 70 with respect to the axis Y and allows the movable detent 14 to be forced by the spring S to its upward position (see FIG. 15), where sinusoidal groove 64 is no longer in alignment with the groove 56 in the slot 50. In this orientation, the tip T of the selector detent pin P is extended upward under bias from the spring S into the throughbore 52 such that the tip T is locked into position within and cannot move out of the throughbore 52. With the selector detent pin P locked in place in the throughbore 52, the shaft 20 cannot rotate. As can be seen from FIG. 5, in this orientation, the flat 23 of the shaft 20 is not engaged with the trigger arm A, and the trigger arm A is thereby in the position that will not allow the firearm to be fired, i.e. the "SAFE" mode (FIG. 17). Hence, when the movable detent 14 is in its upward position and the selector detent pin P is aligned with the throughbore 52, the firearm will remain locked in the "SAFE" mode.

Figure 19:
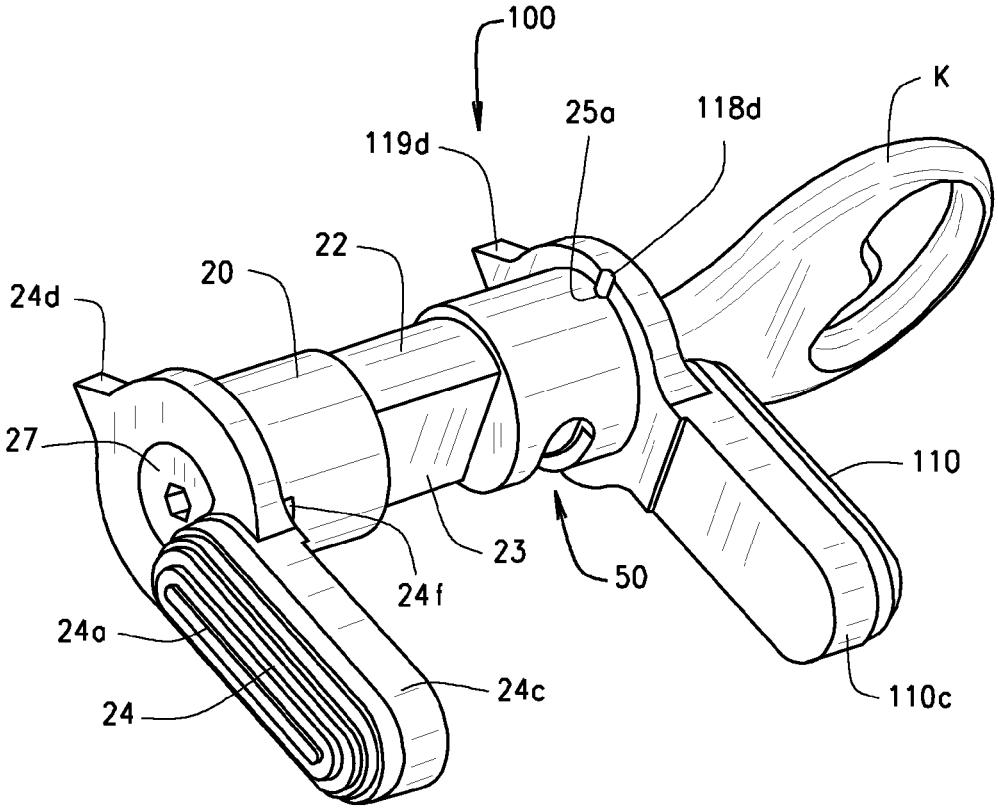
FIG. 19 is a perspective view of an ambidextrous embodiment of the lockable safety selector switch of the present invention.
Figure 20:
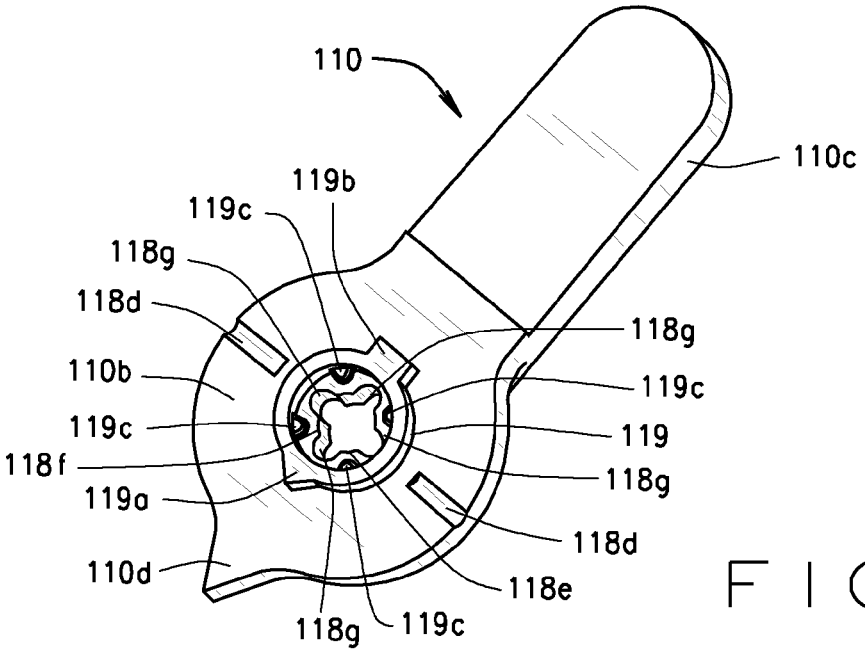
FIG. 20 is an underside perspective view of an ambidextrous lever for the ambidextrous lockable safety selector switch of FIG. 19.

An alternate ambidextrous embodiment of the lockable firearm safety selector switch is shown at 100 in FIGS. 19 and 20. The switch 100 has all the same components as the switch 10 except that in place of the cap 18, an opposing or "bookend" ambidextrous lever 110 is attached to the distal end 25 of the shaft 20. As can be seen in FIG. 20, the ambidextrous lever 110 has a lower surface 110*b* and a somewhat clover-leaf shaped keyhole aperture 118*e* is formed in the center of the surface 110*b*. The keyhole aperture 118*e* has a generally circular central portion 118*f* with four matching radially expanded semicircular alcoves 118*g* spaced equidistant from one another about the central circular portion 118*f*.

The keyhole aperture 118*e* in the cap 110 is configured to allow the head of the key K to freely pass through the keyhole aperture 118*e* to facilitate operative engagement of the key K with the protrusion 84 and the protrusion 96 on the cam 16, with the protrusion 96 configured to fit within the bore 99 of the key K.

A generally ring-shaped protrusion 119 projects from the lower surface 110*b*, with an arrowhead 119*a* that extends outwardly from one end and a rectangular lug 119*b* that extends outwardly generally opposite the lug 119*a*. A set of four matching semicircular protrusions 119*c* are formed within the protrusion 119. All of the protrusions 119*c* are spaced equidistant from one another about the inner perimeter of the protrusion 119. The protrusions 119*c* are approximately half the height of the protrusion 119, with flat tops having chamfered edges. Hence, the configuration of the lower surface 110*b* of the ambidextrous lever 110 mimics that of the cap 18 to facilitate attachment to the distal end 25 of the shaft 20. That is, in referring to FIGS. 4, 19 and 20, and as can be appreciated, the shape of the distal end 25 of the shaft 20 is configured to matingly receive the protrusion 119 in a single orientation so as to attach the ambidextrous lever 110 to the distal end 25 and close and seal the bore 26.

Unlike the detachable lever 24, the ambidextrous lever 110 does not have a throughbore for attachment with a screw. Instead, the ambidextrous lever 110 has a pair of weld channels 118*d* that mate with the two corresponding weld notches 25*a* formed in the distal end 25 of the shaft 20. In order to secure the ambidextrous lever 110 in place when mated to the distal end 28 of the bore 26, the ambidextrous lever 110 is welded at the weld channels 118*d* and 25*a* (not shown).

While we have described in the detailed description a single configuration that may be encompassed within the disclosed embodiments of this invention, numerous other alternative configurations, that would now be apparent to one of ordinary skill in the art, may be designed and constructed within the bounds of our invention as set forth in the claims. Moreover, the above-described novel lockable safety selector switch of the present invention can be arranged in a number of other and related varieties of configurations without expanding beyond the scope of our invention as set forth in the claims.

For example, the firearm selector switch 10 of the present invention can be readily modified for ambidextrous use by attaching to or forming a second lever arm, opposite the lever arm 24, at the distal end 28 of the body 20 of the switch 10 such that the second lever arm is positioned outside the receiver R when the switch 10 is assembled in the receiver R. Similarly, switch 10 can alternately be configured with the lever arm 24 as a separate component that attaches to the shaft 20 with a screw or some other similar attaching device.

Additional variations or modifications to the configuration of the novel lockable safety selector switch 10 of the present invention may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of our invention.

What is claimed is:

1. A lockable safety selector switch configured to replace a manufacturer's original safety selector switch for a firearm having a selector detent pin, the lockable safety selector switch comprising:

a. a body configured to selectively rotate about an axis in the firearm directly between a SAFE position that prevents the firearm from firing and a FIRE position that allows the firearm to fire the body defining an opening in an outer surface of the body to receive at least a portion of the selector detent pin when the lockable safety selector switch is positioned within the firearm;

b. a locking mechanism comprising a rotatable cam housed at least in part within the body, the cam engaging and selectively allowing at least a portion of the selector detent pin to enter the opening in the body to prevent rotation of the body and thereby lock the body in the SAFE position, the cam further configured to rotate within the body to selectively urge the selector detent in out of the opening in the body to allow rotation of the body out of the SAFE position and thereby unlock the body, the cam having a cam interlock element;

c. a body interlock element positioned on the body to operatively engage with the cam interlock element, the body interlock element being complementary to the cam interlock element; and d. a biasing member operatively associated with the cam, the biasing member urging the cam interlock element into engagement with the body interlock element such that when the complimentary interlock elements are engaged with each other, the cam is substantially prevented from rotating within the body;

wherein the lockable safety selector switch is configured such that the firearm requires no modification in order for the lockable safety selector switch to replace the original safety selector switch and operate to lock and unlock the switch.

2. The lockable safety selector switch of claim 1, wherein the locking mechanism comprises a movable detent movable between a first position and a second position, the movable detent engaging and selectively allowing at least a portion of the selector detent pin to enter the opening in the body to prevent rotation of the body and thereby lock the body in the SAFE position when the movable detent is in the detent first position.

3. The lockable safety selector switch of claim 2, wherein the movable detent retracts into a recess in the body when moving from the detent second position to the detent first position.

4. The lockable safety selector switch of claim 3, wherein the body is configured to allow the selector detent pin to move between a first pin position and a second pin position, and wherein the movable detent engages the selector detent pin at the first pin position when the movable detent is at the detent first position to selectively allow at least a portion of the selector detent pin to enter the recess to prevent rotation of the body and thereby lock the body in the SAFE position.

5. The lockable safety selector switch of claim 4, wherein the body and movable detent are configured such that when the movable detent is positioned at the detent first position at least a portion of the selector detent pin engages the movable detent in the recess at a position below the bottom of the groove to restrain the selector detent pin from travel along the groove and to thereby prevent the body from rotation and lock the body in the SAFE position.

6. The lockable safety selector switch of claim 5, wherein when the selector detent pin selectively engages the movable detent at the detent second position such that the selector detent pin is free to travel away from the movable detent along the groove and thereby allow the body to rotate to the FIRE position.

7. The lockable safety selector switch of claim 4, wherein a biasing member engages the selector detent pin to urge the selector detent pin toward the movable detent.

8. The lockable safety selector switch of claim 7, wherein the biasing member comprises a spring.

9. The lockable safety selector switch of claim 2, wherein the cam selectively urges the movable detent between the first and second detent positions.

10. The lockable safety selector switch of claim 1, further comprising a key configured to forcibly engage the cam to overcome, at least in part, the bias to selectively allow the cam to rotate to lock or unlock the safety selector switch.

11. The lockable safety selector switch of claim 10, wherein the key is configured to rotate the cam to selectively lock or unlock the safety selector switch.

12. A lockable safety selector switch for a firearm comprising a receiver and a safety selector detent pin, the switch comprising:

a. a body having a first end and a second end and an outer surface, the body having a selector lever attached to the first end; the body defining a cavity extending inwardly from the second end and a having a groove formed in the outer surface of the body proximate the second end; the groove being sized to receive the selector detent pin and extending part way about the outer surface of the body; the groove including a first end and a second end; the body defining a fixed detent at the first end of the groove and a bore at the second end of the groove; the bore being in communication with the cavity;

b. a cam positioned in the cavity; the cam comprising a disc having opposed upper and lower surfaces and a cam shaft extending from the lower surface; the cam shaft having a radial surface; the cam disc being sized to be rotatably positioned in the body cavity; the cam shaft being sufficiently long to extend across the bore at the second end of the groove in the outer surface of the body when the cam is positioned in the cavity; the disc upper surface defining a key receptacle, whereby when a key is received by the key receptacle, the cam can be rotated within the cavity by rotation of the key;

c. a movable detent positioned in the bore at the second end of the groove; the movable detent having an upper surface and a lower surface, the lower surface being concave; the moveable detent upper surface engaging the radial surface of the cam shaft; the lower surface of the detent engaging the selector detent pin; whereby the moveable detent translates axially in the bore between a first position and a second position in response to rotation of the cam; whereby, when the detent is in the first position, the concave surface of the movable detent is in alignment with the first end of the groove in the outer surface of the body and thereby allows the selector detent pin to travel between the first and second ends of the groove, such that the body can be rotated by the selector lever; and whereby when the moveable detent is in the second position, the selector detent pin extends through the groove into the bore, such that the body cannot be rotated;

d. a cap secured to the body to close the cavity; the cap defining a key hole in alignment with the key receptacle of the cam; the key hole being configured to enable a key to pass through the cap to engage the key receptacle; the cap being positionally fixed relative to the body; and e. a biasing member positioned between an end wall of the body cavity and the cam, the biasing member biasing the cam toward the cap.

13. The lockable safety selector switch of claim 12, wherein the first surface of the cam disc defines a first segment and a second segment; the first segment being thicker than the second segment; the first and second segments being shaped to complement each other.

14. The lockable safety selector switch of claim 13, wherein the second segment is generally crescent-shaped.

15. The lockable safety selector switch of claim 12, wherein the key receptacle comprises a protrusion extending from the upper surface of the cam disc with a recess formed in the protrusion, the recess being shaped to complement the end of the key which is to be received in the key receptacle.

16. The lockable safety selector switch of claim 12, wherein the cap includes a lower surface and a flat upper surface; the cap and key receptacle comprise complimentary rotational positioning elements; the biasing member urging the positioning element of the key receptacle into engagement with the positioning element of the cap; whereby when the complimentary rotational positioning elements are engaged with each other, the cam is substantially prevented from rotating within the body.

17. The lockable safety selector switch of claim 12, wherein the body is generally cylindrical with a central axis, the body configured to selectively rotate about the axis in the firearm between a SAFE position that prevents the firearm from firing and a FIRE position that allows the firearm to fire.

18. In combination with a firearm originally equipped with an original safety selector switch configured to rotate in the firearm directly between a SAFE position that prevents the firearm from firing and a FIRE position that allows the firearm to fire and a movable safety selector detent pin that operatively engages the original safety selector switch, a lockable safety selector switch configured to replace the original safety selector switch, the lockable safety selector switch comprising:

a. a body configured to selectively rotate in the firearm directly between a SAFE position that prevents the firearm from firing and a FIRE position that allows the firearm to fire, the body defining an opening in an outer surface of the body to receive at least a portion of the selector detent pin;

b. a locking mechanism comprising a rotatable cam housed at least in part within the body, the cam engaging the selector detent pin so as to selectively allow at least a portion of the selector detent pin to extend into the opening in the body to prevent rotation of the body and thereby lock the body in the SAFE position, the cam further configured to rotate within the body to selectively urge the selector detent in out of the opening in the body to allow the body to rotate out of the SAFE position and thereby unlock the body, the cam having a cam interlock element;

c. a body interlock element positioned on the body to operatively associate with the cam interlock element, the body interlock element being complementary to the cam interlock element;

d. a biasing member operatively associated with the cam, the biasing member urging the cam interlock element into engagement with the body interlock element such that when the complimentary interlock elements are engaged with each other, the cam is substantially prevented from rotating within the body; and e. a key configured to forcibly engage the cam to overcome, at least in part, the bias to selectively allow the cam to rotate to lock or unlock the safety selector switch, the key being further configured to rotate the cam to selectively lock or unlock the safety selector switch;

wherein the lockable safety selector switch is configured such that the firearm requires no modification for the lockable safety selector switch to replace the original safety selector switch and operate to lock and unlock the switch.

19. The combination of claim 18, wherein the body is configured to rotate within the firearm to orient between the SAFE and FIRE positions.

20. The combination of claim 18, wherein the locking mechanism comprises a movable detent movable in the locking mechanism between a first detent position and a second detent position, the movable detent operatively associated with the selector detent pin to selectively allow at least a portion of the selector detent pin to extend into the opening in the body when the movable detent is in the first detent position.

* * * * *

UNITED STATES PATENT AND TRADEMARK OFFICE

CERTIFICATE OF CORRECTION

PATENT NO. : 8,650,790 B2
APPLICATION NO. : 13/671200
DATED : February 18, 2014
INVENTOR(S) : Bruce Dionne et al.

It is certified that error appears in the above-identified patent and that said Letters Patent is hereby corrected as shown below:

In the Claims

In Column 10, line 64, after the word detent replace “in” with --pin--.

In Column 13, line 31, after the word detent replace “in” with --pin--.

Signed and Sealed this
Twenty-seventh Day of May, 2014

Michelle K. Lee

Michelle K. Lee
*Deputy Director of the United States Patent and Trademark Office*